US006626353B1

(12) United States Patent
Fort

(10) Patent No.: US 6,626,353 B1
(45) Date of Patent: Sep. 30, 2003

(54) SIFT PROOF CONTAINER AND METHOD OF FOLDING AND SEALING A SIFT PROOF CONTAINER

(75) Inventor: Wesley C. Fort, Norcross, GA (US)

(73) Assignee: Nordson Corporation, Westlake, OH (US)

( * ) Notice: Subject to any disclaimer, the term of this patent is extended or adjusted under 35 U.S.C. 154(b) by 377 days.

(21) Appl. No.: 09/305,799

(22) Filed: Apr. 28, 1999

(51) Int. Cl.[7] ..... B65D 5/00

(52) U.S. Cl. ..... 229/132; 229/136; 493/151; 493/130; 493/131

(58) Field of Search ..... 229/132, 134, 229/162, 136; 493/151, 130, 131

(56) References Cited

U.S. PATENT DOCUMENTS

| | | | | |
|---|---|---|---|---|
| 3,194,474 A | * | 7/1965 | Rumberger | 229/132 |
| 3,934,791 A | | 1/1976 | Dick et al. | 229/37 |
| 4,498,619 A | * | 2/1985 | Roccaforte | 229/132 X |
| 5,472,137 A | | 12/1995 | Jenkins | 229/134 |
| 5,540,774 A | * | 7/1996 | Smitherman | 118/315 |
| 5,688,218 A | | 11/1997 | Jenkins | 493/151 |
| 5,711,477 A | | 1/1998 | Jenkins | 229/136 |
| 5,806,756 A | * | 9/1998 | Jenkins | 229/136 |

OTHER PUBLICATIONS 117 pages of drawings submitted by applicant.*

* cited by examiner

*Primary Examiner*—Tri M. Mai
(74) *Attorney, Agent, or Firm*—Wood, Herron & Evans, L.L.P.

(57) ABSTRACT

A sift proof container comprising an open end having a plurality of flaps including first and second minor flaps and first and second major flaps. The minor flaps have opposed edges when folded inwardly to respective closed positions over the open end. The major flaps are configured to be folded inwardly to respective closed positions over the minor flaps and a first major flap includes opposite, recessed side edges positioned adjacent to respective corners of the minor flaps. Adhesive is positioned proximate three free edges of the second major flap to form a seal with the first major flap and the minor flap in the closed positions thereof. A pair of separate adhesive deposits are disposed on outer surfaces of the corners of the minor flaps that mate with the first major flap and/or on an inner surface of complimentary corners of the first major flap. These separate adhesive deposits extend only partially toward the opposed edges of the first and second minor flaps.

13 Claims, 3 Drawing Sheets

SIFT PROOF CONTAINER AND METHOD OF FOLDING AND SEALING A SIFT PROOF CONTAINER

FIELD OF THE INVENTION

The present invention generally relates to containers and, more specifically, to sift proof containers designed to prevent leakage of particulate contents or infestation by insects.

BACKGROUND OF THE INVENTION

Many containers, such as cartons, boxes or other less rigid containers, are constructed from paper-based materials and include open ends having a plurality of flaps. These containers are usually folded from a flat condition into an erected condition, after which a desired product may be introduced into the container. The flaps are then folded and connected together, typically using an adhesive, to close the ends of the container.

Particulate products, such as granulated or powdered products, require packaging that will prevent leakage of the product during shipment and storage. Plastic liners may be used inside cartons or boxes for this purpose, however, such liners increase packaging costs. To reduce costs, linerless sift proof containers have been developed to store and ship particulate products. The end flaps of these sift proof containers must be tightly sealed in a manner that prevents the contents from sifting out between the flaps. With typical sift proof containers, opposite minor end flaps are first folded down, followed by a first major flap and then a second major flap. Typically, all of the flaps receive adhesive deposits in the form of intermittent or continuous adhesive beads to ensure that the seams between the various flaps are sealed in a sift proof manner. In the case of food products, this also prevents insects from entering the sealed container.

As the development of sift proof containers has progressed, certain problems have been addressed relative to increasing sift proof seal integrity and reducing costs associated with adhesive and paper product. One manner of reducing the required amount of adhesive and simultaneously improving the integrity of the sift proof seal has been through the use of embossments on the various flaps. Raised embossments provide opposed surfaces of the flaps lying in closer relation and, therefore, the usual gap between the flaps does not need to be filled with as much adhesive. Also, a momentary decrease in the volume of dispensed adhesive during packaging will be less likely to compromise the integrity of the seal. Prior sift proof containers have also included a modified first major flap that enables direct contact between embossed portions of the minor flaps and a corresponding embossed portion of the second major flap. This more effectively prevents leakage of particulate product and reduces the amount of adhesive and paper product used in constructing the container.

Despite the various developments in the area of sift proof containers, improvements are still needed to increase sift proof seal integrity, reduce adhesive requirements and reduce product contamination by adhesive. In these regards, even the more recently developed sift proof containers have used adhesive beads that extend completely across both minor flaps. This requires the minor flaps to directly abut one another when folded into closed positions. If a gap is left between the minor flaps, the adhesive applied across the minor flaps can drop into the container and contaminate the contents. Increasing the size of the minor flaps increases the amount of paper product and adds to the expense of the container. Also, the use of adhesive extending completely across the minor flaps increases the amount of adhesive and likewise increases the associated packaging costs.

SUMMARY OF THE INVENTION

The present invention provides a sift proof container including a sidewall enclosing an interior space. The container includes at least one open end having a plurality of flaps. The flaps comprise first and second minor flaps and first and second major flaps. The minor flaps have opposed edges when folded inwardly to their respective closed positions and the major flaps are configured. to be folded inwardly to respective closed positions over the minor flaps. The first major flap includes opposite side edges that are recessed with respect to sidewall portions of the container. These side edges are positioned adjacent to respective corners of the minor flaps. The second major flap includes at least three free edges and a fourth edge connected with the sidewall. Adhesive is positioned proximate the three free edges of the second major flap to seal against the first major flap and the minor flaps when the minor and major flaps are folded to their closed positions. Initially, adhesive may be placed along two opposite side edges of the second major flap or along hinged edges of the minor flaps.

In one aspect of the invention, a pair of separate adhesive deposits are made on outer surfaces of the corners of the minor flaps that mate with the first major flap. These separate adhesive deposits extend only partially toward the opposed edges of the first and second minor flaps when the first and second minor flaps are folded to their closed positions. This significantly reduces the amount of adhesive used to construct the sift proof container. This aspect of the invention also prevents contamination of product within the container by adhesive. The pair of separate adhesive deposits may alternatively or also be made on an inner surface of the first major flap at opposite corners thereof adjacent to the respective corners of the first and second minor flaps. To achieve similar benefits, this pair of separate adhesive deposits also extends only partially toward the opposed edges of the first and second minor flaps when the first and second minor flaps are folded to their closed positions.

In the preferred embodiment, at least one of the second major flap and the first and second minor flaps have embossments positioned between the sidewall and the recessed side edges when the minor and major flaps are folded to their closed positions. As part of this aspect of the invention, the adhesive positioned proximate at least two of the free edges contacts the embossments when the minor and major flaps are folded to their closed positions. The first major flap includes opposite corner portions connected with the sidewall and each of the opposite, recessed edges more specifically extends inward to define one edge of each of the corner portions. The separate adhesive deposits are substantially confined to the corner portions when the minor and major flaps are folded to their closed positions.

More specifically, both the minor flaps and opposite edge portions of the second major flap can have raised embossments that mate with each other in the closed positions. The raised embossments end at the corner portions to provide a nesting space for the first minor flap and the separate adhesive deposits are substantially confined within this nesting space. As another aspect of the invention, inner opposed edges of the first and second minor flaps may be spaced a substantial distance apart when folded to their closed positions and, because of the use of separate adhesive deposits as described above, adhesive will not fall through the gap between the minor flaps into the container. The adhesive positioned proximate the three free edges of the second major flap may include separate or continuous adhesive beads or other types of adhesive deposits that result in a caulking seal with the respective minor flaps and the first major flap.

The invention further contemplates methods of folding and sealing a plurality of flaps disposed about the open end of a container to construct a sift proof container. These methods generally involve folding and sealing a container as described above. In addition to the advantages described above, the methods described herein may be performed using typical packaging machinery. As less adhesive may be used in carrying out the present invention, the methods described herein may be performed in a more cost effective manner.

Additional advantages, objects and features of the invention will become more readily apparent to those of ordinary skill in the art upon review of the following detailed description of the preferred embodiments taken in conjunction with the accompanying drawings.

DETAILED DESCRIPTION OF THE PREFERRED EMBODIMENTS

Figure 1:
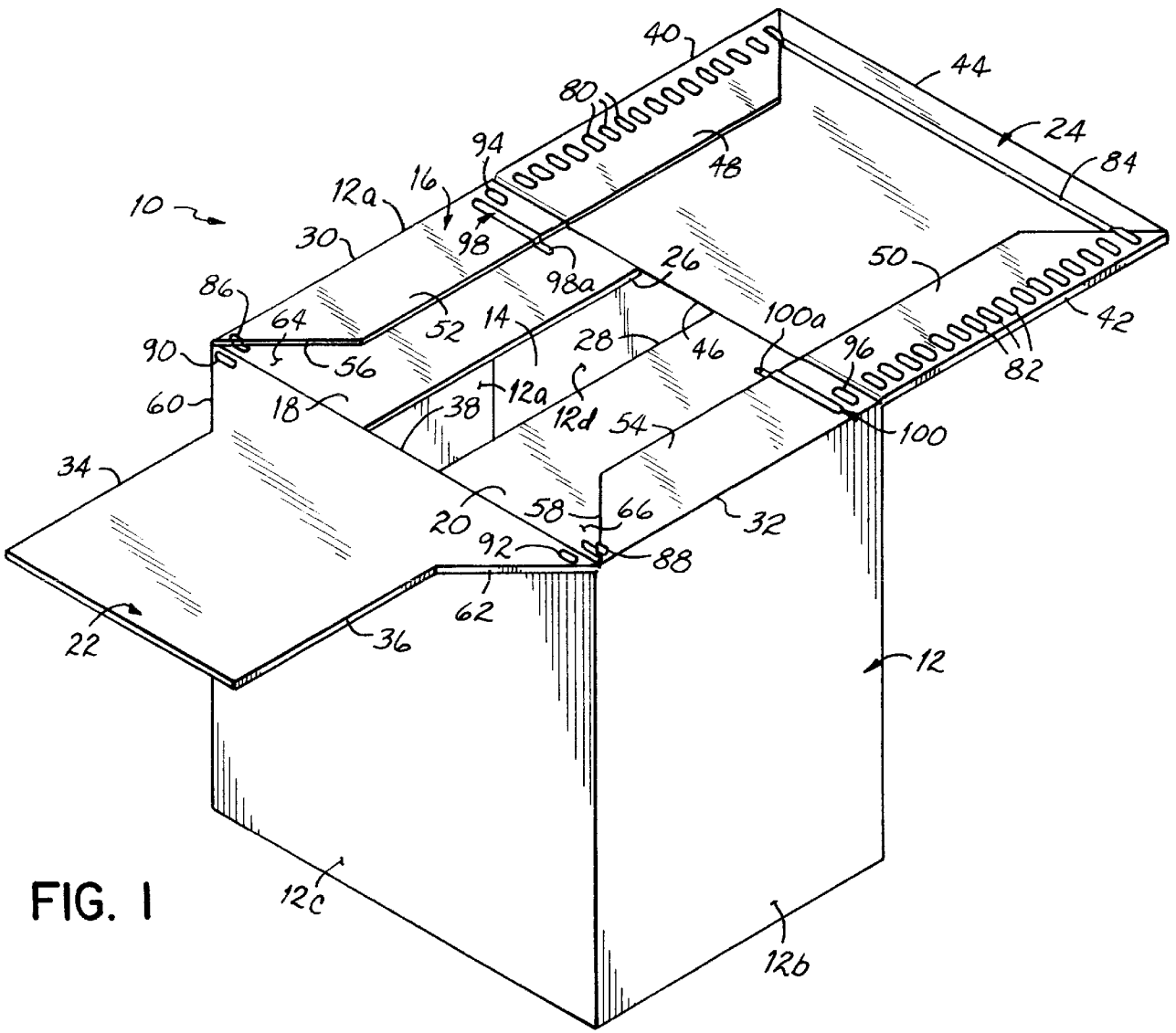
FIG. 1 is a perspective view of a sift proof container constructed in accordance with one preferred embodiment of the invention.
Figure 2:
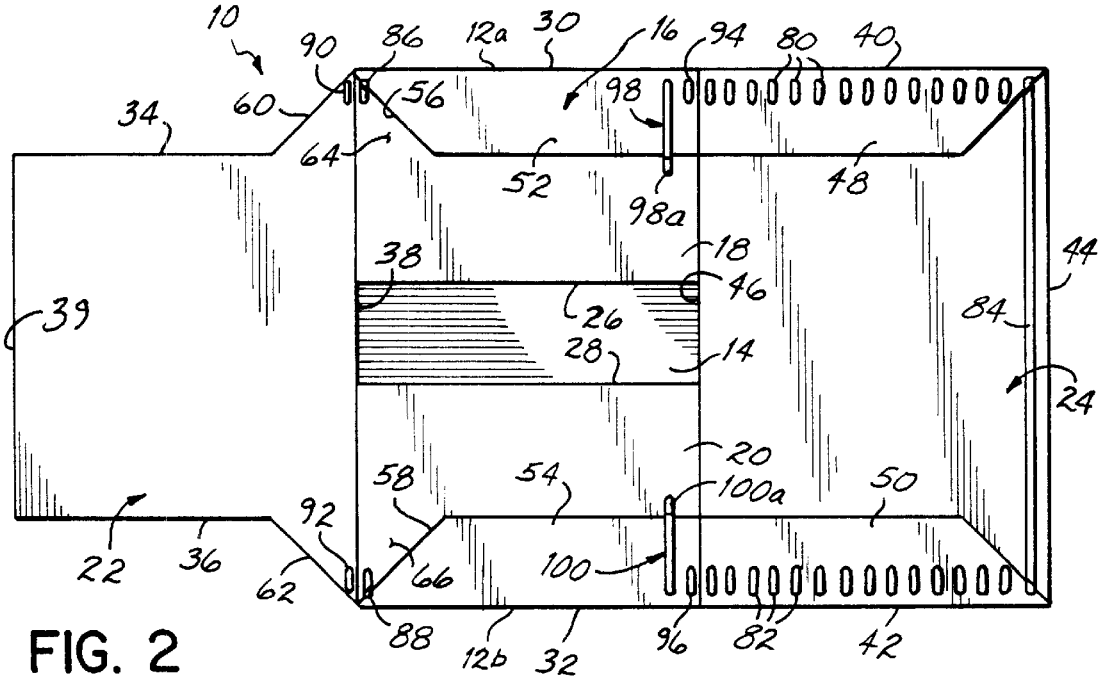
FIG. 2 is a top view of the sift proof container shown in FIG. 1.

Referring to FIGS. 1 and 2, a sift proof container 10, constructed in accordance with one embodiment of the invention, includes a sidewall 12 having portions 12*a*, 12*b*, 12*c*, 12*d* enclosing an interior space 14 and having at least one open end 16. Such containers may take many different forms and shapes and, typically, will include two open ends sealed in the same manner as described herein. Container 10 may be formed of various materials including paper, paperboard or cardboard.

Container 10 includes first and second minor flaps 18, 20 and first and second major flaps 22, 24. Minor flaps 18, 20 have opposed edges 26, 28 distal from respective hinged edges 30, 32. As one benefit of the invention, edges 26, 28 may be spaced a substantial distance apart to save material costs. Minor flaps 18, 20 are connected in a hinged manner to sidewall 12 by respective edges 30, 32. First major flap 22 includes side edges 34, 36 recessed inwardly with respect to the sidewall portions 12*a* and 12*b* of container 10. An edge 38 connects first major flap 22 to sidewall 12 in a hinged manner and flap 22 includes an opposite free edge 39. Second major flap 24 includes at least three free or unhinged edges 40, 42, 44 and an edge 46 connecting second major flap 24 to sidewall 12 in a hinged manner. Second major flap 24 further includes embossments 48, 50 that mate with embossments 52, 54 of complimentary shape respectively contained on minor flaps 18, 20. Embossments 52, 54 include angled edges 56, 58 adapted to follow angled edge portions 60, 62 of side edges 34, 36 when minor flaps 18, 20 and first major flap 22 are folded into their closed positions. In this manner, nesting spaces 64, 66 are created at respective corner portions of minor flaps 18, 20 for receiving corresponding corners generally defined by edges 60, 62 of first major flap 22. Preferably, each embossment 48, 50, 52, 54 is an area raised in thickness by one half the thickness of first major flap 22.

Adhesive deposits, preferably in the form of beads 80, 82, are disposed on the inner surface of second major flap 24 proximate first and second free edges 40, 42. Alternatively, beads 80, 82 or other types of adhesive deposits may be initially placed on minor flaps 18, 20 to achieve the same type of sealing connection, such as will be described further below. Another adhesive bead 84 is disposed as a caulking bead along the third free edge 44. A pair of adhesive deposits, in the form of beads 86, 88, are disposed on outer surfaces of minor flaps 18, 20 such that they are substantially confined within nesting spaces 64, 66. Separate beads of adhesive 90, 92 are disposed adjacent to beads 86, 88 on an inner surface of first major flap 22.

Each of the adhesive beads 86, 88, 90, 92 extends only partially toward the respective opposed edges 26, 28 of minor flaps 18, 20 to significantly reduce adhesive requirements. Relative to comparable containers of the past, for example, overall adhesive requirements of the invention may be reduced by about 50%. Beads 86, 88, 90, 92 are shown at about their minimum desirable length. It will be understood that somewhat longer beads may be used as long as they do not approach edges 26, 28 too closely so as to cause adhesive to squeeze out of the resulting folded joint. Edges 26, 28 may be cut back further than shown or more closely abut one another. Beads 86, 88, 90, 92 are adapted to seal the corner junction between first major flap 22 and first and second minor flaps 18, 20 when first major flap 22 is folded to a closed position. The short length of beads 86, 88, 90, 92 requires only a small amount of adhesive and ensures that adhesive does not enter interior space 14, while providing a sift proof seal at these respective corners. Additional adhesive beads 94, 96 and 98, 100 are provided at opposite corners of minor flaps 18, 20. Beads 98, 100 are optionally lengthened, as shown, such that portions 98*a*, 100*a* extend off of respective embossments 52, 54. In this manner, first major flap 22 is held against minor flaps 18, 20 with a tack hold and, if production stops, the first major flap 22 will not unfold. All adhesive used in carrying out the invention is desirably a quick setting adhesive, such as hot melt adhesive.

Figure 3:
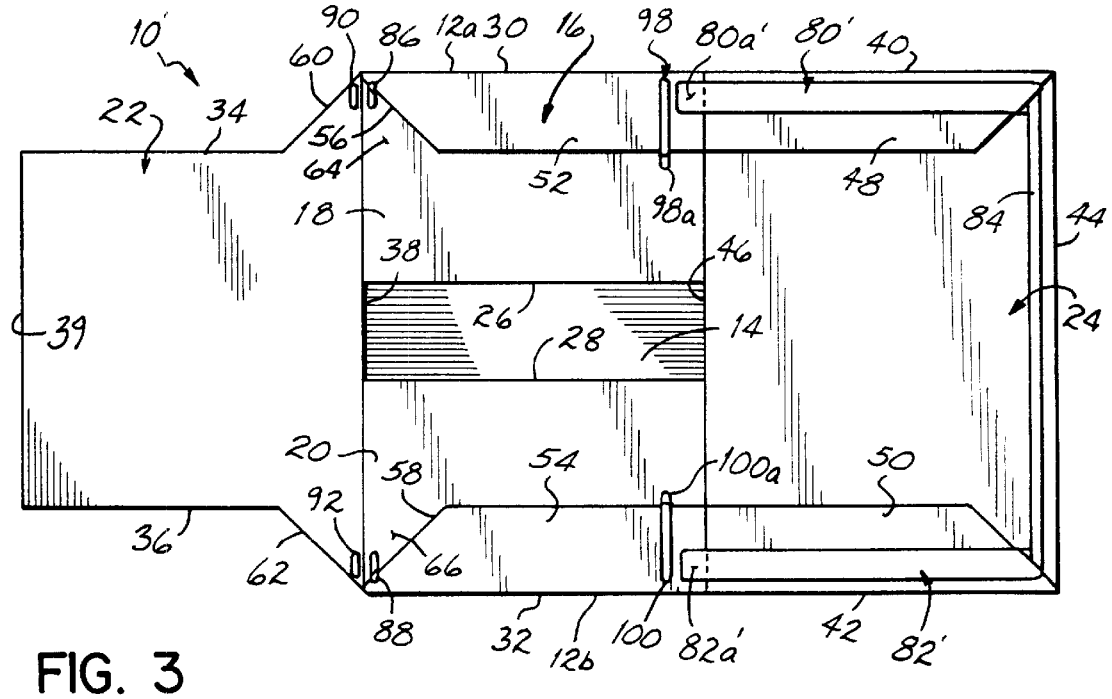
FIG. 3 is a top view similar to FIG. 2, but showing an alternative embodiment.

FIG. 3 illustrates one of the many possible alternative embodiments of this invention. In this regard, like reference numerals represent like structure and elements with respect to FIGS. 1 and 2, while reference numerals with prime (') marks illustrate modified elements. Container 10' is constructed using continuous adhesive beads 80', 82' disposed along opposite free edges 40, 42 of second major flap 24. Adhesive beads 80', 82' may further include extensions or portions 80*a*', 82*a*' disposed on respective minor flaps 18, 20 to take the place of beads 94, 96 shown in FIGS. 1 and 2. Adhesive beads 98, 100 may remain in place to facilitate the tack hold described above.

Figure 4:
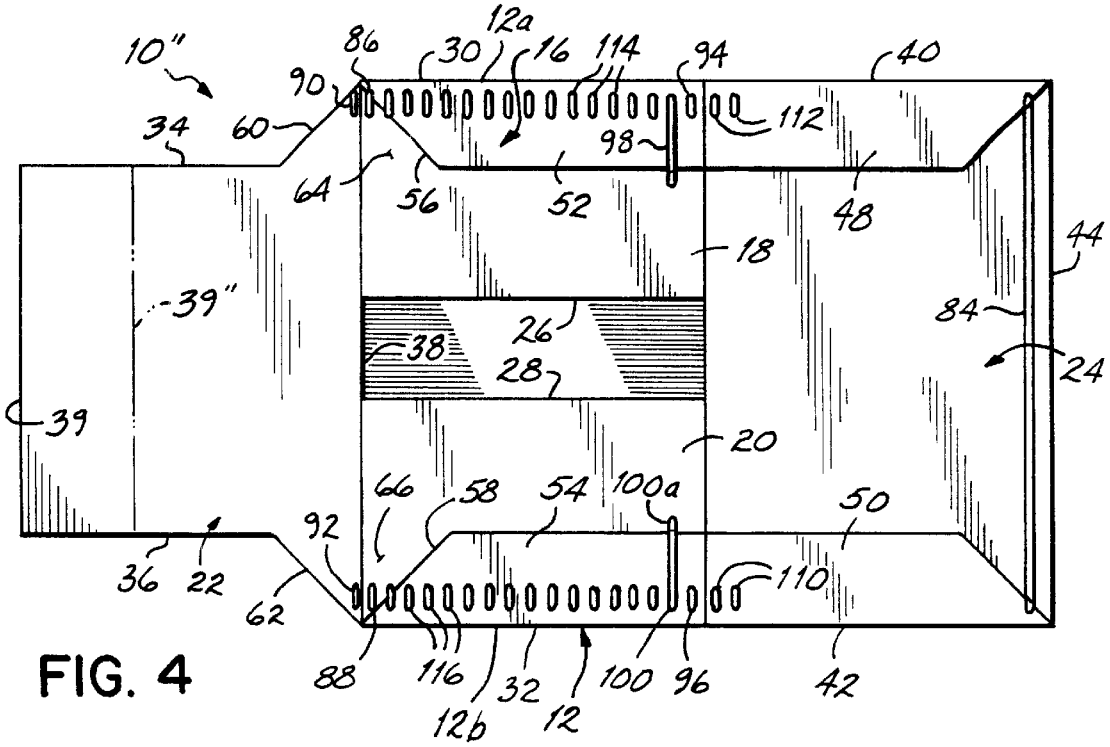
FIG. 4 is a top view similar to FIGS. 2 and 3, but showing another alternative embodiment.

FIG. 4 illustrates another alternative embodiment of the invention wherein like reference numerals represent like structure and elements with respect to FIGS. 1–3, while reference numerals with double prime marks (") illustrate modified elements. The placement of adhesive is similar to the first and second embodiments, except that adhesive beads 80, 82 and 80', 82' have been replaced by adhesive beads 110, 112. To facilitate a sift proof seal along these edges, adhesive beads 114, 116 are placed along the hinged edges 30, 32 of minor flaps 26, 28. Alternatively, other forms of adhesive deposits may be placed on minor flaps 26, 28. Optional adhesive beads 98, 100 may be used to facilitate the tack hold described above. As one further option, first major flap 22 may be shortened such that outer edge 39 is located farther inward, as shown by edge 39".

A method of folding and sealing a sift proof container in accordance with the invention will be understood with specific reference to FIGS. 1 and 2, but also generally applicable to container 10' of FIG. 3. A first set of adhesive beads 80, 82, 84 is deposited on an inner surface of second major flap 24 proximate edges 40, 42, 44. A second set of adhesive beads 86, 88, 90, 92 is deposited on abutting corner portions of first major flap 22 and respective minor flaps 18, 20. These beads are confined generally within nesting spaces 64, 66 when first major flap 22 is folded inwardly to a closed position. Additional adhesive beads 94, 96, 98, 100 are deposited at the opposite ends of minor flaps 18, 20. First major flap 22 is folded inwardly over the outer surfaces of the minor flaps to seal the corner portions with adhesive beads 86, 88, 90, 92. First major flap 22 will be received between embossments 52, 54 and the end thereof will be tacked down by adhesive bead portions 98*a*, 100*a*. Second major flap 24 is then folded inwardly over the outer surfaces of first major flap 22 and embossments 52, 54 with adhesive deposits 80, 82, 84 forming caulking seals around the three edges 40, 42, 44.

Various aspects of the present invention may be carried out individually or in various combinations. For example, embossments 48, 50, 52, 54 may be eliminated if desired for a particular application. However, this can increase the adhesive requirements by increasing the gap that must be filled with adhesive between the second major flap and the minor flaps.

The configuration of the various flaps and the embossments may be modified as well. With regard to the embossments, for example, these may take on various shapes and may be used on only the minor flaps or only the second major flap.

While the present invention has been illustrated by a description of the preferred embodiments and while these embodiments have been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known. However, the invention itself should only be defined by the appended claims.

I claim:

1. A sift proof container comprising:

a plurality of sidewall portions enclosing an interior space adapted to receive a particulate product, an open end having a plurality of flaps including first and second minor flaps and first and second major flaps, the minor flaps having opposed edges when folded inwardly to respective closed positions over the open end, and the majored flaps configured to be folded inwardly to respective closed positions over the minor flaps, wherein the first major flap includes opposite side edges positioned adjacent to respective corners of the minor flaps and recessed with respect to opposite sidewall portions and opposite corner portions connected with the sidewall, each of the opposite, recessed edges extending inwardly to define one edge of each said corner portion, and the second major flap includes at least three free edges and a fourth edge connected with the sidewall, wherein the minor flaps each have raised embossments that mate with the second major flap when the minor and major flaps are in their closed positions, and the raised embossments end at the corner portions to provide a nesting space for the first minor flap in its closed position, adhesive positioned proximate the three free edges of the second major flap and sealing against the first major flap and the minor flaps when the minor and major flaps are folded to their closed positions, and a pair of separate adhesive deposits on outer surfaces of the corners of the minor flaps that mate with the first major flap, said pair of separate adhesive deposits extending only partially toward the opposed edges of the first and second minor flaps when the first and second minor flaps are folded to their closed positions, wherein the separate adhesive deposits are substantially confined to the corner portions when the minor and major flaps are folded to their closed positions, said separate adhesive deposits being substantially confined within the nesting space.

2. The sift proof container of claim 1, wherein the second major flap has embossments positioned between the side wall and the recessed side edges when the minor flaps and the second major flap are folded to their closed positions, and the adhesive positioned proximate at least two of said free edges contacts the embossments when the minor and major flaps are folded to their closed positions.

3. The sift proof container of claim 1, wherein the adhesive positioned proximate the three free edges includes a continuous adhesive bead extending along one of the free edges which is located opposite to a hinged edge of the second major flap and a series of adhesive deposits extending along two of the free edges.

4. The sift proof container of claim 1, further comprising:

a second pair of separate adhesive deposits on an inner surface the first major flap at opposite corners thereof adjacent to the respective corners and adhesive deposits of the minor flaps, wherein said second pair of adhesive deposits extend only partially toward the opposed edges of the first and second minor flaps when the first and second minor flaps are folded to their closed positions.

5. The sift proof container of claim 1, wherein inner opposed edges of the first and second minor flaps are spaced a substantial distance apart when folded to their closed positions.

6. The sift proof container of claim 1, wherein the adhesive positioned proximate the three free edges includes continuous adhesive beads extending lengthwise along the three free edges.

7. A method of sealing a plurality of flaps disposed about the open end of a container, the flaps including first and second major flaps and first and second minor flaps, the first major flap including opposite side edges recessed from opposite sidewall portions of the container and extending from inner surfaces that define corner portions adapted to mate with outer surfaces of respective corner portions on the minor flaps, and the second major flap including at least three free edges and an edge connected with the sidewall, the method comprising:

depositing a first set of adhesive beads so as to sealingly contact the second major flap proximate the three free edges when folded to a closed position, depositing a second set of adhesive beads in an area confined to the mating corner portions of the first major flap and the minor flaps, folding the first major flap inwardly over outer surfaces of the minor flaps to seal the corner portions with the second set of adhesive beads, and folding the second major flap over the first major flap and into the closed position to seal two of the free edges against the respective minor flaps and to seal the remaining free edge with the first major flap using the first set of adhesive beads.

8. The method of claim 7, wherein depositing the second set of adhesive beads further comprises placing respective adhesive beads on the inner surface of the first major flap and on the outer surfaces of the first and second minor flaps.

9. The method of claim 7, further comprising:

depositing beads of adhesive on the first and second minor flaps to contact and hold down an end of the first major flap after the first folding step.

10. The method of claim 7, further comprising:

embossing the second major flap to extend a surface thereof in areas positioned adjacent the recessed edges of the first major flap, and depositing a portion of the first set of adhesive beads on the embossed areas of the second major flap.

11. The method of claim 10, further comprising:

embossing each of the minor flaps to extend surfaces thereof in areas that contact the embossed areas of the second major flap after the second folding step.

12. A sift proof container comprising:

a sidewall enclosing an interior space adapted to receive a particulate product, an open end having a plurality of flaps including first and second minor flaps and first and second major flaps, the minor flaps having opposed edges when folded inwardly to respective closed positions over the open end, and the major flaps configured to be folded inwardly to respective closed positions over the minor flaps, wherein the first major flap includes opposite, recessed side edges positioned adjacent to respective corners of the minor flaps and opposite corner portions connected with the sidewall, each of the opposite, recessed side edges extending inwardly to define one edge each of said corner portion and the second major flap includes at least three free edges and a fourth edge connected with the sidewall, wherein the minor flaps each have raised embossments that mate with the second major flap when the minor and major flaps are in their closed positions, and the raised embossments end at the corner portions to provide a nesting space for the first minor flap in its closed position, adhesive positioned proximate the three free edges of the second major flap and sealing against the first major flap and the minor flaps when the minor and major flaps are folded to their closed positions, and a pair of separate adhesive deposits on an inner surface of the first major flap at opposite corners thereof adjacent to the respective corners of the first and second minor flaps, said pair of separate adhesive deposits extending only partially toward the opposed edges of the first and second minor flaps when the first and second minor flaps are folded to their closed positions and wherein the separate adhesive deposits are substantially confined to the corner portions when the minor and major flaps are folded to their closed positions, said separate adhesive deposits being substantially confined within the nesting space.

13. A sift proof container comprising:

a plurality of sidewall portions enclosing an interior space adapted to receive a particulate product, an open end having a plurality of flaps including first and second minor flaps and first and second major flaps, the minor flaps having opposed edges spaced substantially apart when folded inwardly to their closed positions over the opened end, and the major flaps configured to fold inwardly to respective closed positions over the minor flaps, wherein the first major flap includes opposite side edges positioned adjacent to respective corners of the minor flaps and recessed with respect to opposite sidewall portions, and the second major flap includes at least three free edges and a fourth edge connected with the sidewall, adhesive positioned proximate the three free edges of the second major flap and sealing against the first major flap and the minor flaps when the minor and major flaps are folded to their closed positions, and a pair of separate adhesive deposits mating the minor flaps with the first major flap, said pair of separate adhesive deposits being substantially confined to the respective corners of the minor flaps when the first and second minor flaps are folded to their closed positions.

* * * * *